US009080435B2

(12) United States Patent
Li et al.

(10) Patent No.: US 9,080,435 B2
(45) Date of Patent: Jul. 14, 2015

(54) UPGOING DRAINHOLES FOR REDUCING LIQUID-LOADING IN GAS WELLS

(75) Inventors: Baoyan Li, Spring, TX (US); Harald Grimmer, Niedersachsen (DE); Volker Krueger, Niedersachsen (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 478 days.

(21) Appl. No.: 13/218,094

(22) Filed: Aug. 25, 2011

(65) Prior Publication Data

US 2012/0048568 A1 Mar. 1, 2012

Related U.S. Application Data

(60) Provisional application No. 61/377,695, filed on Aug. 27, 2010.

(51) Int. Cl.

| | |
|---|---|
| ***E21B 43/00*** | (2006.01) |
| ***E21B 43/12*** | (2006.01) |
| *E21B 43/30* | (2006.01) |

(52) U.S. Cl.
CPC ..... *E21B 43/121* (2013.01); *E21B 43/305* (2013.01)

(58) Field of Classification Search
CPC ..... E21B 43/121; E21B 43/122
USPC ..... 166/50, 369; 175/61
See application file for complete search history.

(56) References Cited

U.S. PATENT DOCUMENTS

| | | | | |
|---|---|---|---|---|
| 4,436,165 | A | 3/1984 | Emery | |
| 4,444,265 | A | 4/1984 | Schmidt | |
| 4,519,463 | A | 5/1985 | Schuh | |
| 4,646,836 | A | 3/1987 | Goodhart | |
| 4,778,007 | A | 10/1988 | Van Laar | |
| 5,301,760 | A | 4/1994 | Graham | |
| 5,343,967 | A | 9/1994 | Kruger | |
| 6,173,797 | B1 | 1/2001 | Dykstra et al. | |
| 6,591,903 | B2 | 7/2003 | Ingle et al. | |
| 7,274,991 | B2 | 9/2007 | Tabarovsky et al. | |
| 7,413,032 | B2 | 8/2008 | Krueger | |
| 7,934,563 | B2 | 5/2011 | Oglesby | |
| 2005/0092486 | A1 | 5/2005 | Mones | |
| 2008/0066903 | A1 * | 3/2008 | Zupanick | 166/245 |
| 2009/0194292 | A1 | 8/2009 | Oglesby | |
| 2011/0061937 | A1 | 3/2011 | Orban et al. | |

FOREIGN PATENT DOCUMENTS

WO 2009025574 A1 2/2009

OTHER PUBLICATIONS

"Coalbed Methane: Principles and Practices, Chapter 10" by Halliburton, 2007.*

* cited by examiner

*Primary Examiner* — Jennifer H Gay
*Assistant Examiner* — Steven MacDonald
(74) *Attorney, Agent, or Firm* — Mossman, Kumar & Tyler, PC

(57) ABSTRACT

Gas from a tight gas formation may be produced using a drain hole having a juncture to a main wellbore and a terminal end at a depth higher than the juncture. The terminal end may be positioned in the tight gas formation.

10 Claims, 2 Drawing Sheets

UPGOING DRAINHOLES FOR REDUCING LIQUID-LOADING IN GAS WELLS

CROSS-REFERENCE TO RELATED APPLICATIONS

This application claims priority from U.S. Provisional Application Ser. No. 61/377,695 filed Aug. 27, 2010, the disclosure of which is incorporated herein hereby in its entirety.

BACKGROUND OF THE DISCLOSURE

1. Field of the Disclosure

The disclosure relates to enhancing production of hydrocarbons from tight gas reservoirs.

2. Description of the Prior Art

Tight gas refers to "natural gas" produced from reservoirs having relatively low permeability. Tight gas can be trapped in sandstone or carbonate or shale formations, of which the low permeability and porosity impede the gas flow. In contrast to conventional gas formation that flow with relatively ease from drilled wells, the recovery of tight gas reservoirs can be uneconomical in many situations. The present disclosure is directed to well construction methods and systems that allow tight gas formations to be more economically produced.

SUMMARY OF THE DISCLOSURE

In aspects, the present disclosure provides a method for recovering gas from a tight gas formation. The method may include flowing a gas from the tight gas formation using a drain hole having a juncture to a main wellbore and a terminal end at a depth higher than the juncture. The terminal end may be positioned in the tight gas formation.

In aspects, the present disclosure also provides a system for recovering gas from a tight gas formation. The system may include a main wellbore and at least one drain hole having a juncture to the main wellbore and a terminal end positioned in the tight gas formation and at a depth higher than the juncture.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The disclosure is best understood with reference to the accompanying figures in which like numerals refer to like elements, and in which.

DESCRIPTION OF THE EMBODIMENTS OF THE DISCLOSURE

Aspects of the present disclosure may be utilized to recover gas, e.g., natural gas, from subterranean formations. The present disclosure is susceptible to embodiments of different forms. That is, certain embodiments of the present disclosure may be utilized in other applications. The specific embodiments of the present disclosure described herein, therefore, are presented with the understanding that the present disclosure is to be considered an exemplification of the principles of the disclosure, and is not intended to limit the disclosure to that illustrated and described herein.

Liquid-loading may be a problem for gas wells that produce a liquid, such as water. The produced liquid may be mobile water in a reservoir, aquifer water, coning water from a water zone, condensate gas, and/or human injected water. As used herein, the term "water" includes water-based liquids, such as brine. When the flow rate of a produced gas is sufficiently high, the produced liquid form droplets that become entrained in the flowing gas and are to be conveyed the surface. However, in some instances, the pressure of the reservoir does not generate a fluid flow rate high enough to carry the liquid droplets to the surface. In those instances, the liquid droplets fall to the bottom of the well, or other low lying area. As water accumulates in the well, a water column is built-up and rises. If high enough, the water column can block the communication between the borehole and the producing formation and stop gas production.

Figure 1:
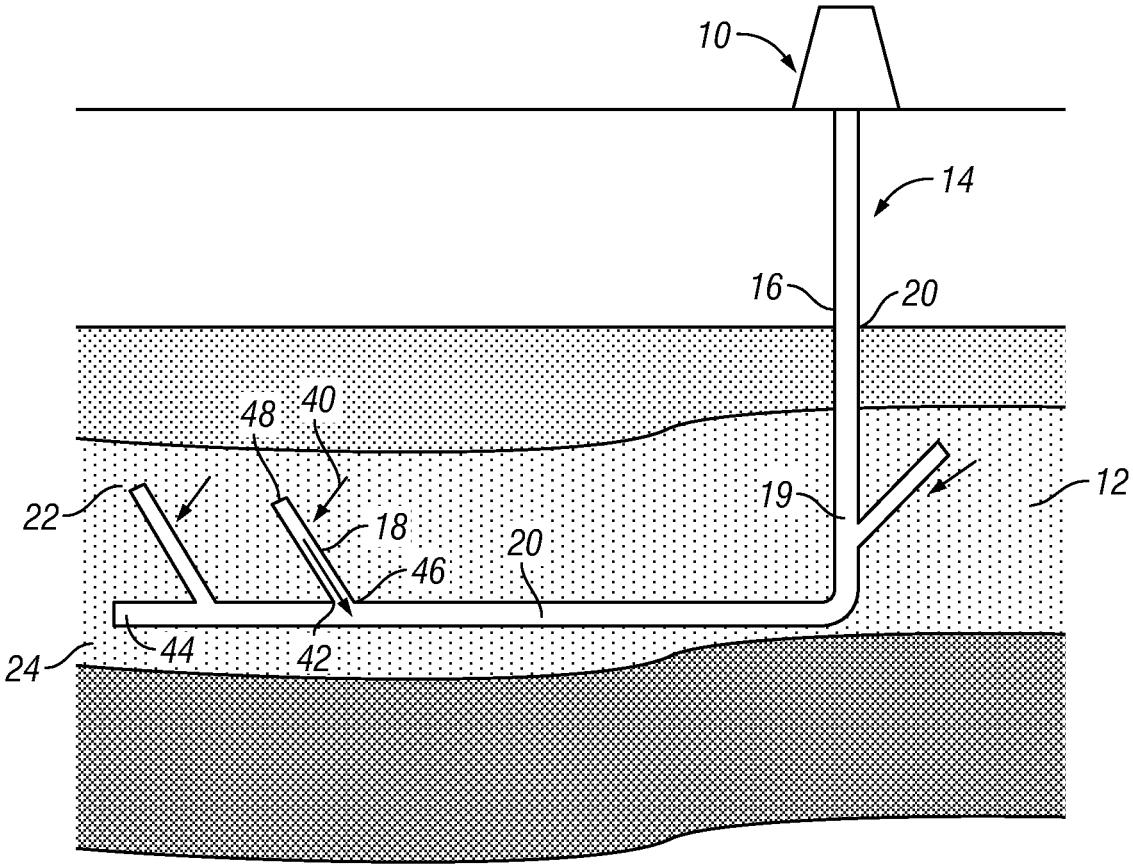
FIG. 1 schematically illustrates a hydrocarbon recovery facility for recovering gas from a tight gas formation.

Referring to FIG. 1, there is shown a hydrocarbon recovery facility 10 for recovering gas from one or more subterranean reservoirs 12 using a well 14 that is configured to delay or minimize the impairment of production due to liquid-loading. The subterranean reservoir 12 may be a "tight gas" formation. For purposes of the present disclosure, a "tight gas" formation may be a reservoir that has low porosity and permeability. Such reservoirs may be formed of sandstone, shale, carbonate rocks, or other similar materials. One definition for a tight-gas reservoir is a rock with matrix porosity of ten percent or less and permeability of 0.1 millidarcy or less. In contrast, conventional gas reservoirs may have a permeability level of 0.01 to 0.5 Darcy. Thus, generally speaking, a "tight gas" formation has a permeability level in the millidarcy to microdarcy range.

To mitigate liquid-loading, in one arrangement, a well 14 for producing gas from the reservoir or formation 12 may have a complex architecture that includes a main wellbore 16 and one or more "branch" or "lateral" bores 18. The main wellbore 16 may include a vertical section 19 and a non-vertical section 20 (e.g., a horizontal section) that intersects the reservoir 12. The branch bores 18 may include non-horizontal sections (e.g., inclined or deviated from horizontal or even vertical). Generally, the well architecture is selected to expose as much of the reservoir 12 to the well 14 as feasible. It should be understood that the FIG. 1 embodiment is one non-limiting arrangement and suitable wells may have one or more vertical sections, slanted sections, horizontal sections, and/or multiple lateral branches, etc.

The branch bore 18 may be oriented and dimensioned to manage water that is produced along with the gas from the reservoir 12. For ease of explanation, such branch wellbores 18 will be referred to as drain holes. In embodiments, one or more drain holes 18 may be oriented to have a greater than ninety degree deviation angle or an "upgoing" orientation. That is, the drain holes 18 may have a slope or angle that causes water to drain from the upgoing drain hole 18 into the main wellbore 16 by primarily gravity.

Also, the upgoing drain holes 18 may be constructed to obtain higher gas production rate to lift the water droplets to the surface, i.e. to maximize gas production and minimize water production. For example, in embodiments, the upgoing drain hole 18 may be positioned to increase exposure to the relatively higher pressure gas in an upper zone 22 of the reservoir 12. For instance, the up-going drain holes 18 may be oriented such that the drain hole 18 has a juncture 46 with the main bore 16 and a terminal end 48 that is proximate to the upper zone 22. It should be noted that the juncture 46 is at a depth lower than the terminal end 48. Initially, the reservoir 12 may have a higher gas saturation and lower water saturation at the upper zone 22 than at a lower zone 24. This variation in saturation is due to water having higher density than that of gas. Thus, the water sinks to the lower zone 24 and gas rises to the upper zone 22. Also, the gas at the upper zone 22 may have a higher pressure and therefore may provide the expansion energy to push fluids to a main wellbore 16. Moreover, to make use of this higher pressure, the dimensions of the up-going drain holes 18 may be selected to allow the expansion energy of the reservoir 12 to develop sufficient pressure to flow liquids out to the main wellbore 16. In embodiments, the diameter of the upgoing drain hole may be in the range of 0.5 inches to 4 inches, although it should be understood that this range is merely illustrative. Moreover, the length of the drain hole 18 may be selected to allow sufficient inflow of gas to generate the flow rate needed to evacuate the drain hole 18 of water.

Additionally, in embodiments, parameters such as deviation angle, length, and distribution density of the drain holes 18 may be configured with respect to the anisotropy of the reservoir 12. For example, these and related parameters may be varied to maximize gas production and minimize liquid production in a tight gas formation wherein the permeability may have a large anisotropy. In some, but not all, situations, an anisotropy of five to one, may be considered a large anisotropy. In other instances, a large anisotropy has a value sufficient to substantially influence the direction of flow of the resident gas.

Figure 2A:
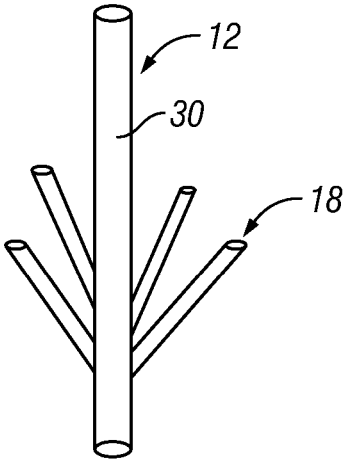
FIG. 2A illustrates a well having a vertical section that includes upgoing drain holes.
Figure 2B:
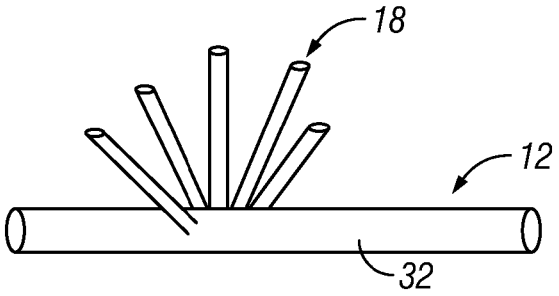
FIG. 2B illustrates a well having a horizontal section that includes upgoing drain holes.
Figure 2C:
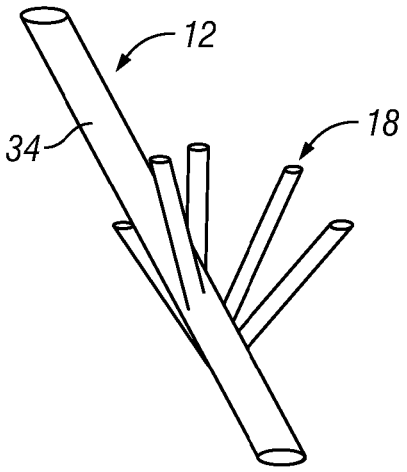
FIG. 2C illustrates a well having a deviated section that includes upgoing drain holes.
Figure 2D:
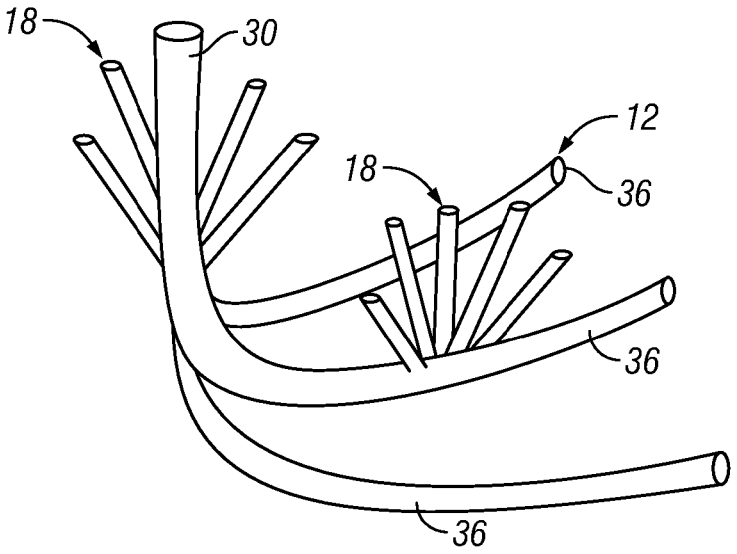
FIG. 2D illustrates a well having a vertical section and a lateral bore that includes upgoing drain holes.

Referring now to FIGS. 2A-2D, there are shown illustrative examples of wells 12 that incorporate upgoing drain holes 18. In FIG. 2A, a well 12 having a vertical or substantially vertical section 30 includes a plurality of upgoing drain holes 18. In FIG. 2B, a well 12 having a horizontal or substantially horizontal section 32 includes a plurality of the upgoing drain holes 18. In FIG. 2C, a well 12 having a deviated or slanted section 34 includes a plurality of the upgoing drain holes 18. In FIG. 2D, the well 12 has a plurality of lateral bores 36 that radiate from the vertical section 30. The vertical section 30 and one or more of the branch bores 36 include a plurality of the upgoing drain holes 18. While a plurality of upgoing drain holes 18 are shown, some wells may include only one drain hole 18. Generally, however, because of the relatively low permeability of tight gas formations, it may be desirable to penetrate the reservoir 12 with multiple drain holes. Moreover, the drain holes 18 may be arrayed at one axial location and/or distributed along a section of the well 12. It should be understood that the upgoing drain holes 18 need not be straight. For example, the upgoing drain hole 18 may include shallow valley.

The upgoing drain hole 18 may be "open hole" or lined with a liner/casing. Also, the upgoing drain hole 18 may include completion equipment such as screens, pressure control devices, valves, etc.

Referring to FIG. 1, during an exemplary production, gas 40 from the tight gas formation 12 flows into the upgoing drain holes 18. The produced water 42 flows downward into the main well 16. As noted previously, the entire length of the upgoing drain hole 18 need not be deviated; i.e., some section may have little or no gradient. The pressure of the gas in the drain hole 18, in addition to gravity, may push the produced water along the drain hole 18 to the juncture 46. It may ease the removal of the accumulated water in the well 16. For example, the water may flow to a low area in the main well 14, such as a well bottom 44. In some embodiments, the produced water may reside in the low area or sump. In other embodiments, pumps or other fluid mover may be used to flow the produced water to the surface. That is, the well 16 may also be configured to minimize the risk that produced water will impede the production of gas.

Wells using upgoing drain holes to produce from tight gas reservoirs may be constructed using any number of techniques and methodologies. For example, a well may be a new well wherein the main wellbore and upgoing drain holes are engineered in accordance with a planned reservoir management strategy. However, the upgoing drain holes may be formed in an existing well through re-entry. For example, gas reservoirs can lose expansion energy over time. Such wells may be re-worked by adding upgoing drain holes.

Exemplary tools for forming upgoing drain holes include, but are not limited to, drilling assemblies conveyed by coiled tubing, short-radius drilling systems, laser drilling systems, fluid jet drilling systems, percussive drilling systems, electric powered drilling systems, and/or any other kind of making a hole into a reservoir. In certain applications, the upgoing holes may be formed using perforating tools that use explosives (e.g., shaped charges). Furthermore, techniques such as hydraulic fracturing, acid treatment, and other well stimulation techniques may be used to increase the permeability of the formation.

From the above, it should be appreciated that what has been disclosed includes, in part, a method for recovering gas from a tight gas formation. The method may include flowing a gas from the tight gas formation using a drain hole having a juncture to a main wellbore and a terminal end at a depth higher than the juncture. The terminal end may be positioned in the tight gas formation.

From the above, it should be appreciated that what has been disclosed includes, in part, a system for recovering gas from a tight gas formation. The system may include a main wellbore and at least one drain hole having a juncture to the main wellbore and a terminal end positioned in the tight gas formation and at a depth higher than the juncture.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

We claim:

1. A method for recovering gas from a tight gas formation, comprising:

flowing gas from the tight gas formation using an existing well having a main wellbore, the tight gas formation having a reservoir that includes an upper zone and a lower zone, wherein the upper zone has a higher gas saturation and a lower water saturation than the lower zone, and wherein the tight gas formation has an anisotropic permeability;

initiating a re-entry operation after a pressure of the reservoir is not sufficient to carry liquid droplets to the surface, the re-entry operation including forming at least one drain hole having a juncture to the main wellbore and a terminal end at a depth higher than the juncture, the terminal end being positioned at the upper zone of the reservoir;

flowing a gas from the tight gas formation using the at least one drain hole;

selecting a diameter and a length of the at least one drain hole to generate a pressure in the at least one drain hole sufficient to move a produced liquid from the at least one drain hole to the main wellbore, the pressure being generated by an expansion energy of the reservoir;

flowing the produced liquid away from the juncture to a low area along the main wellbore; and removing the produced liquid from the low area along the main wellbore.

2. The method of claim 1 further comprising configuring one or more of: (i) deviation angle, (ii) length, and (iii) distribution density of a drain hole with reference to the anisotropic permeability.

3. The method of claim 1, further comprising using primarily gravity to flow the produced liquid from the juncture with the at least one drain hole to a low area along the main wellbore.

4. The method of claim 1, wherein the at least one drain hole includes a plurality of drain holes, and wherein the plurality of drain holes are oriented to drain the produced liquid to the low section in the main wellbore.

5. A system for recovering gas from a tight gas formation, comprising:

a main wellbore formed in the tight gas formation, the tight gas formation having reservoir that includes an upper zone and a lower zone, wherein the upper zone has a higher gas saturation and a lower water saturation than the lower zone, and wherein the tight gas formation has an anisotropic permeability; and at least one drain hole having a juncture to the main wellbore and a terminal end positioned in the tight gas formation and at a depth higher than the juncture, the terminal end being positioned at the upper zone of the reservoir, wherein a diameter and a length of the at least one drain hole to generate a pressure in the at least one drain hole sufficient to move a produced liquid to the main wellbore, the pressure being generated by an expansion energy of the reservoir, wherein the main wellbore is oriented to flow the produced liquid away from the juncture to a low area along the main wellbore, and wherein the at least one drain hole is formed after the pressure of the reservoir is not sufficient to carry liquid droplets to the surface.

6. The system of claim 5, wherein the at least one drain hole comprises a plurality of drain holes.

7. The system of claim 5, wherein the juncture is formed at a location selected from one of: (i) a horizontal section of the main wellbore, (ii) a vertical section of the main wellbore, and (iii) a deviated section of the main wellbore.

8. The system of claim 5, wherein the main wellbore comprises a plurality of lateral branches, wherein the juncture is positioned in at least one of the plurality of lateral branches.

9. The system of claim 5, further comprising a fluid mover configured to move the produced fluid away from the juncture.

10. A method for recovering gas from a tight gas formation, comprising:

forming a main wellbore in an earthen formation;

positioning a terminal end of at least one drain hole in the tight gas formation to receive the gas from the tight gas formation;

positioning the terminal end closer to a high pressure and high gas saturation zone of the tight gas formation than a low pressure and low gas saturation zone of the tight gas formation; and flowing the gas from the at least one drain hole to the main wellbore at a juncture that is positioned at a depth lower than the terminal end;

generating a pressure in the at least one drain hole sufficient to move a produced liquid to a low section of the main wellbore;

flowing the produced liquid away from the juncture; and removing the liquid accumulated at the low section of the main well wellbore, wherein the tight gas formation has an anisotropic permeability, and a permeability of no greater than one millidarcy, and wherein the at least one drain hole is formed after the pressure of the reservoir is not sufficient to carry liquid droplets to the surface.

* * * * *